US006834114B2

(12) United States Patent
Kobayashi et al.

(10) Patent No.: US 6,834,114 B2
(45) Date of Patent: Dec. 21, 2004

(54) MULTIFUNCTION ACOUSTIC DEVICE

(75) Inventors: Takashi Kobayashi, Yamanashi-ken (JP); Akira Nikaido, Tachikawa (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 319 days.

(21) Appl. No.: 10/038,664

(22) Filed: Jan. 8, 2002

(65) Prior Publication Data

US 2002/0097890 A1 Jul. 25, 2002

(30) Foreign Application Priority Data

Jan. 24, 2001 (JP) ..... 2001-016435

(51) Int. Cl.[7] ..... H04R 25/00
(52) U.S. Cl. ..... 381/396; 381/162; 381/165
(58) Field of Search ..... 381/162, 163, 381/165, 182, 396, 417; 310/27, 80, 81, 154.01–154.08

(56) References Cited

U.S. PATENT DOCUMENTS 5,942,833 A * 8/1999 Yamaguchi ..... 310/268
6,274,955 B1 * 8/2001 Satoh et al. ..... 310/71
6,417,589 B1 * 7/2002 Kuyama et al. ..... 310/81
6,639,992 B2 * 10/2003 Kobayashi et al. ..... 381/396

* cited by examiner

*Primary Examiner*—Suhan Ni
(74) *Attorney, Agent, or Firm*—Dennison, Schultz, Dougherty & MacDonald

(57) ABSTRACT

A rotor having a yoke is rotatably supported in a frame, and a stator provided in the frame at a central portion of the frame. An annular first permanent magnet is provided on the yoke, and an annular second permanent magnet is provided on the yoke. A diaphragm is supported in the frame, and a voice coil is secured to the diaphragm and inserted in a gap formed by the first permanent magnet. At least two coils are provided on the stator for forming magnetic fluxes between the rotor and the stator so as to rotate the rotor.

9 Claims, 8 Drawing Sheets

MULTIFUNCTION ACOUSTIC DEVICE

BACKGROUND OF THE INVENTION

The present invention relates to a multifunction acoustic device used in a portable instrument such as a portable telephone.

There has been provided an acoustic device of the portable instrument in which a speaker is provided for generating sounds of calling signals, and a vibrating motor is provided for informing the receiver of calling signals without generating sounds. In such a device, since both of the speaker and the motor are mounted in the device, the device is increased in size and weight, and in manufacturing cost.

In recent years, there is provided a multifunction acoustic device in order to remove the above described disadvantages. The multifunction acoustic device comprises a speaker having a vibrating plate and a permanent magnet magnetically connected to a voice coil mounted on the vibrating plate of the speaker. The permanent magnet is independently vibrated at a low frequency of 100–150 Hz so as to inform the receiving of calling signals by the vibration of the case of the device, which is transmitted to the body of the user of the device.

FIG. 7 is a sectional view of a conventional electromagnetic induction converter disclosed in Japanese Utility Model Application Laid Open 5-85192. The converter comprises a diaphragm 506 mounted in a case 512 at a periphery thereof, a voice coil 508 secured to the underside of a central portion 507 of the diaphragm 506, a spring plate 511 mounted in the case 512, and a permanent magnet 510 secured to a central portion of the spring plate 511, inserted in the voice coil 508.

By applying a low or high frequency signal to the voice coil 508, the spring plate 511 is vibrated in the polarity direction Y of the magnet 510.

In the device, the diaphragm 506 and the spring plate 511 are relatively moved through the magnetic combination between the voice coil 508 and the magnet 510. Consequently, when a low frequency signal or a high frequency signal is applied to the voice coil 508, both of the diaphragm 506 and the spring plate 511 are sequentially vibrated. As a result, sounds such as voice, music and others generated from the device are distorted, thereby reducing the quality of the sound. In addition, vibrating both of the voice coil 508 and the magnet 510 causes the low frequency vibration of the magnet to superimpose on the magnetic combination of the voice coil 508 and the magnet 510, which further largely distorts the sounds.

FIG. 8 is a sectional view showing a conventional multifunction acoustic device. The device comprises a speaker vibrating plate 603 made of plastic and having a corrugated periphery 603*a* and a central dome, a voice coil 604 secured to the underside of the vibrating plate 603 at a central portion, and a magnet composition 610. The vibrating plate 603 is secured to a frame 609 with adhesives.

The magnetic composition 610 comprises a lower yoke 605, a core 601 formed on the yoke 605 at a central portion thereof, an annular permanent magnet 602 mounted on the lower yoke 605, and an annular upper yoke 606 mounted on the permanent magnet 602. The lower yoke 605 and the upper yoke 606 are resiliently supported in the frame 609 by spring plates 607 and 608. A magnetic gap 611 is formed between a periphery 601*a* of the core 601 and an inside wall 606*a* of the upper yoke 606 to be magnetically connected to the voice coil 604.

When an alternating voltage is applied to the voice coil 604 through input terminals 612*a* and 612*b*, the speaker vibrating plate 603 is vibrated in the direction Y to generate sounds at a frequency between 700 Hz and 5 KHz. If a low frequency signal or a high frequency signal is applied to the voice coil 604, the speaker vibrating plate 603 and the magnetic composition 610 are sequentially vibrated, since the magnetic composition 610 and the speaker vibrating plate 603 are relatively moved through the magnetic combination of the voice coil 604 and the magnet composition 610.

As a result, sounds such as voice, music and others generated from the device are distorted, thereby reducing the quality of the sound. In addition, the driving of both the voice coil 604 and the magnetic composition 610 causes the low frequency vibration to superimpose on the magnetic combination of the voice coil 604 and the magnetic composition 610, which further largely distorts the sounds.

FIG. 9 is a sectional view showing another conventional multifunction acoustic device. The device comprises the speaker vibrating plate 603 made of plastic and having the corrugated periphery 603*a* and the central dome, the voice coil 604 secured to the underside of the vibrating plate 603 at a central portion, and the magnet composition 610. The vibrating plate 603 is secured to the frame 609 with adhesives.

The magnetic composition 610 comprises a lower yoke 703, core 601 formed on the yoke 703 at a central portion thereof, an annular permanent magnet 702 secured to the lower yoke 703, and annular upper yoke 606 having a peripheral wall 606*b* and mounted on the permanent magnet 702. The upper yoke 606 is resiliently supported in the frame 609 by spring plates 707 and 708. A first magnetic gap 701 is formed between a periphery 601*a* of the core 601 and an inside wall of the upper yoke 606 to be magnetically connected to the voice coil 604. A second gap 705 is formed between a periphery 703*a* of the lower yoke 703 and inside wall 606*a* of the upper yoke 606. A driving coil 706 is secured to the frame and inserted in the second gap 705.

When an alternating voltage is applied to the voice coil 604 through input terminals 612*a* and 612*b*, the speaker vibrating plate 603 is vibrated in the direction Y to generate sounds at a frequency between 700 Hz and 5 KHz. If a low frequency signal or a high frequency signal is applied to the voice coil 604, the speaker vibrating plate 603 and the magnetic composition 610 are sequentially vibrated, since the magnetic composition 610 and the speaker vibrating plate 603 are relatively moved through the magnetic combination of the voice coil 604 and the magnet composition 610.

When a high frequency signal for music is applied to the voice coil 604, only the speaker vibrating plate 603 is vibrated. Therefore, there does not occur distortion of the sound. Furthermore, when a low frequency signal is applied to the driving coil 706, only the magnetic composition 610 is vibrated, and the speaker vibrating plate 603 is not vibrated.

However if a high frequency signal is applied to input terminals 612*a*, 612*b*, and a low frequency signal is also applied to input terminals 704*a*, 704*b*, the speaker vibrating plate 603 and magnetic composition 610 are sequentially vibrated, thereby reducing the sound quality.

In the above described conventional devices, both the speaker vibration plate and the magnetic composition are vibrated when a low frequency signal or a high frequency signal is applied to the voice coil. This is caused by the reason that the low frequency vibrating composition is vibrated in the same direction as the high frequency vibrating direction.

Furthermore, in recent years, electric power for operating the portable telephone increases, which causes increase of the temperature of the coil for vibrating the yoke.

SUMMARY OF THE INVENTION

An object of the present invention is to provide a multifunction acoustic device in which a vibrating member is not vibrated together with another vibrating member, thereby removing disadvantages of conventional devices.

Another object of the present invention is to provide an acoustic device which may reduce the temperature of the coil.

According to the present invention, there is provided a multifunction acoustic device comprising a frame, a rotor having a yoke and rotatably supported in the frame, a stator provided in the frame at a central portion of the frame, an annular first permanent magnet provided on the yoke, an annular second permanent magnet provided on the yoke, a diaphragm supported in the frame, a voice coil secured to the diaphragm and inserted in a gap formed by the first permanent magnet, at least two coils provided on the stator for forming magnetic fluxes between the rotor and the stator so as to rotate the rotor.

The rotor is rotatably mounted on the frame by a central shaft.

An eccentric means is provided on the rotor for vibrating the rotor during the rotation of the rotor.

The stator comprises a spider having a hub and a plurality of spokes.

The coils are provided on spokes of the spider.

The yoke has a central upward cylindrical portion, and the stator is disposed in the cylindrical portion.

The eccentric means is a weight eccentrically provided in the rotor.

An annular top yoke is mounted on the first permanent magnet for forming the gap between the top yoke and the cylindrical portion of the yoke.

A driving circuit is provided for energizing the coils for rotating the rotor.

These and other objects and features of the present invention will become more apparent from the following detailed description with reference to the accompanying drawings.

DETAILED DESCRIPTION OF THE PREFERRED EMBODIMENT

Figure 1:
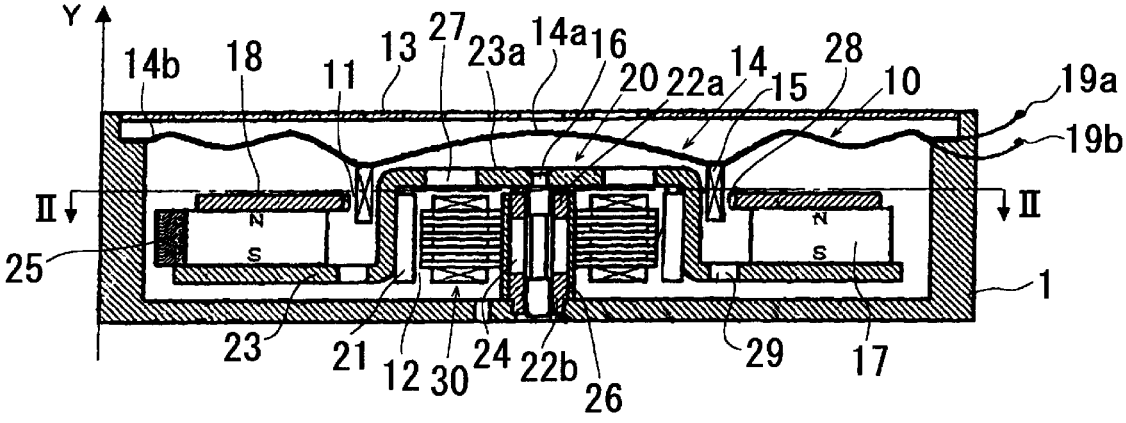
FIG. 1 is a sectional view of a multifunction acoustic device of the present invention.
Figure 2:
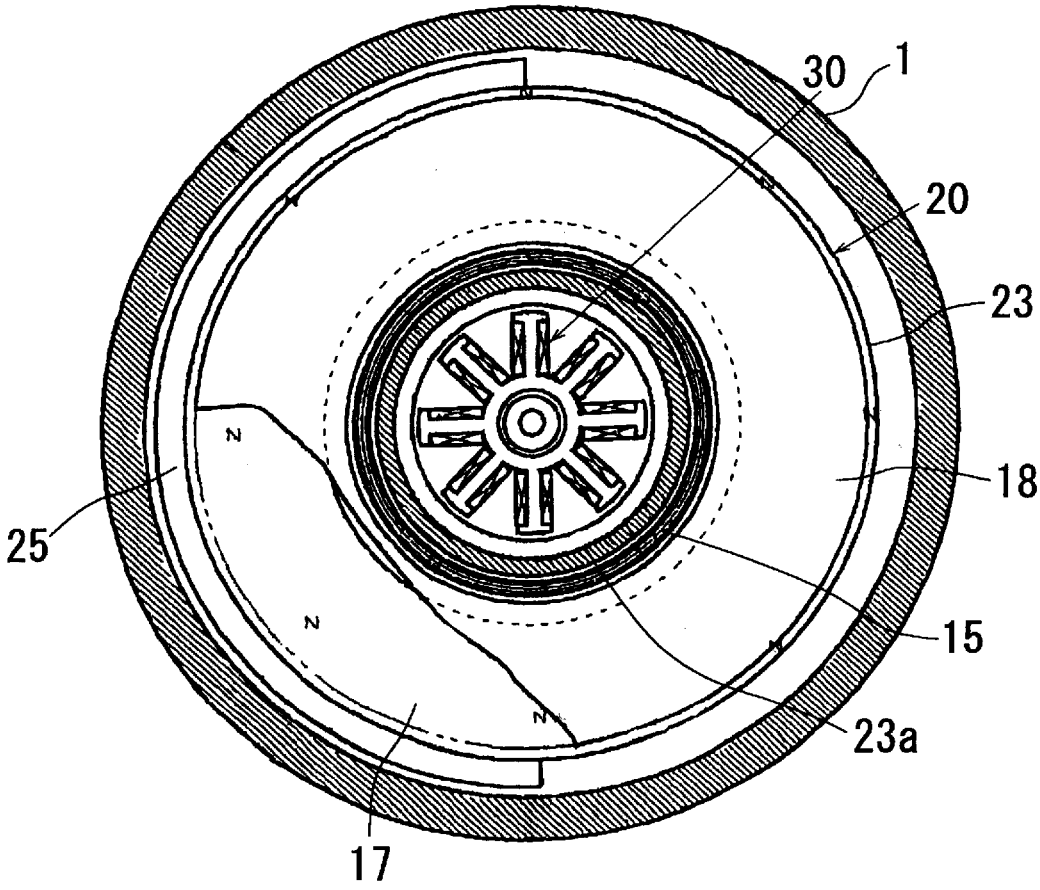
FIG. 2 is a sectional view taken along a line II—II of FIG. 1.

Referring to FIGS. 1 and 2, the multifunction acoustic device of the present invention comprises a sound generating device 10, a rotor 20 and an annular stator 30 provided in a cylindrical frame 1 made of plastic. The sound generating device 10 comprises a speaker diaphragm 14 having a central dome 14*a* and secured to the frame 1 at a periphery 14*b* with adhesives, a voice coil 15 secured to the underside of the speaker diaphragm 14. The speaker diaphragm 14 is covered by a cover 13 having a plurality of sound discharge holes and secured to the frame 1 at a peripheral edge thereof.

The rotor 20 comprises a rotor yoke 23 having a central upward cylindrical portion 23*a* which is secured to a rotor shaft 16. The rotor shaft 16 is rotatably supported by bearings 22*a* and 22*b* secured to a base plate of the frame 1 by a cylinder 26, interposing an oil absorbing member 24 so that the rotor yoke 23 is rotatably mounted on the frame 1. An annular speaker permanent magnet 17 is secured to an annular flat portion of the rotor yoke 23 extending from and around the cylindrical portion 23*a*, and an annular top yoke 18 is secured on the magnet 17. The speaker permanent magnet 17 is magnetized in the same polarity in the axial direction at circumferential positions. Thus, a first magnetic circuit is formed between the top yoke 18 and the cylindrical portion 23*a* of the yoke 23.

Figure 3:
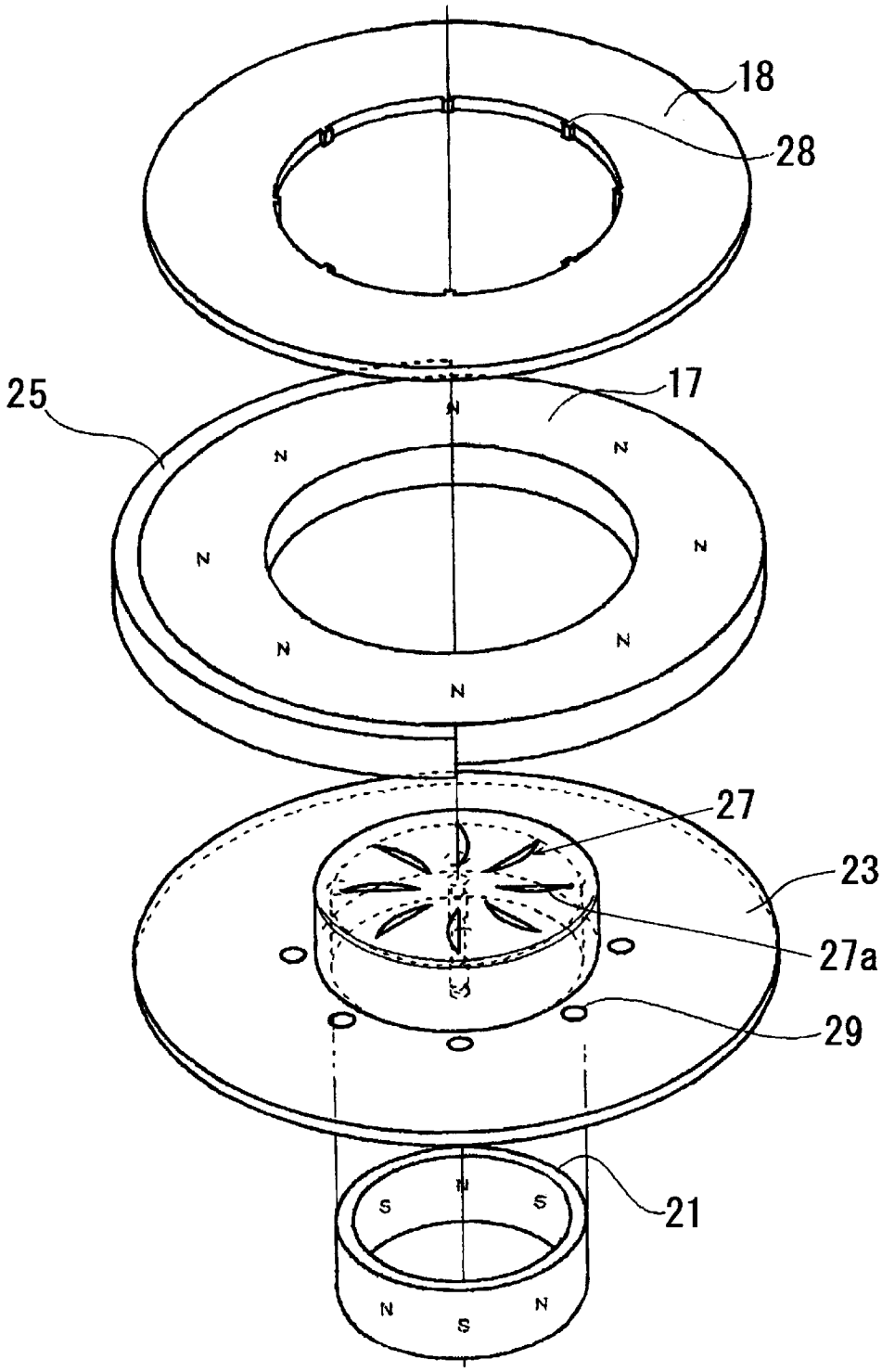
FIG. 3 is an exploded perspective view of a rotor of the multifunction acoustic device of the present invention.

An annular rotor permanent magnet 21 is secured to the inside wall of the cylindrical portion 23*a*. As shown in FIG. 3, the rotor permanent magnet 21 is magnetized in eight polarities at eight circumferential positions. Thus, a second magnetic circuit is formed between the rotor 20 and the stator 30. The voice coil 15 is disposed in a speaker gap 11 formed between the inside wall of the top yoke 18 and the outside wall of the cylindrical portion 23*a* of the yoke 23.

Figure 5:
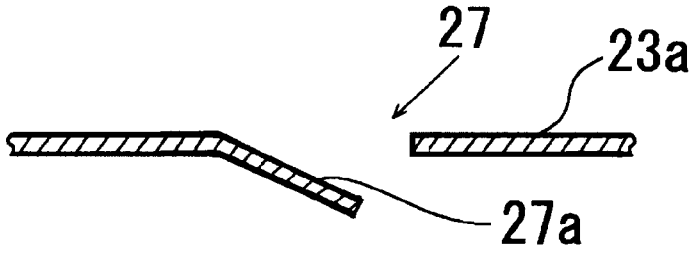
FIG. 5 is a sectional view showing a blade of a cooling fan.

As shown in FIGS. 2 and 3, a semicircular weight 25 made of plastic including heavy particles such as tungsten particles is secured to the outside wall of the speaker magnet 17 and mounted on the rotor yoke 23. As another means, the permanent magnet 17 may be eccentrically disposed with respect to the rotor shaft 16. A motor gap 12 is formed between the inside wall of the rotor permanent magnet 21 and the stator 30. As shown in FIG. 3, a cooling fan 27 is provided on the top plate of the cylindrical portion 23*a* for cooling the stator 30. Each blade 27*a* is formed by cutting the top plate and downwardly bending as shown in FIG. 5.

In addition, a plurality of projections 28 are formed on the inside wall of the top yoke 18 for cooling the voice coil 15. Further, a plurality of heat discharge holes 29 are formed in the yoke 23 for discharging air heated by the voice coil 15.

Figure 4:
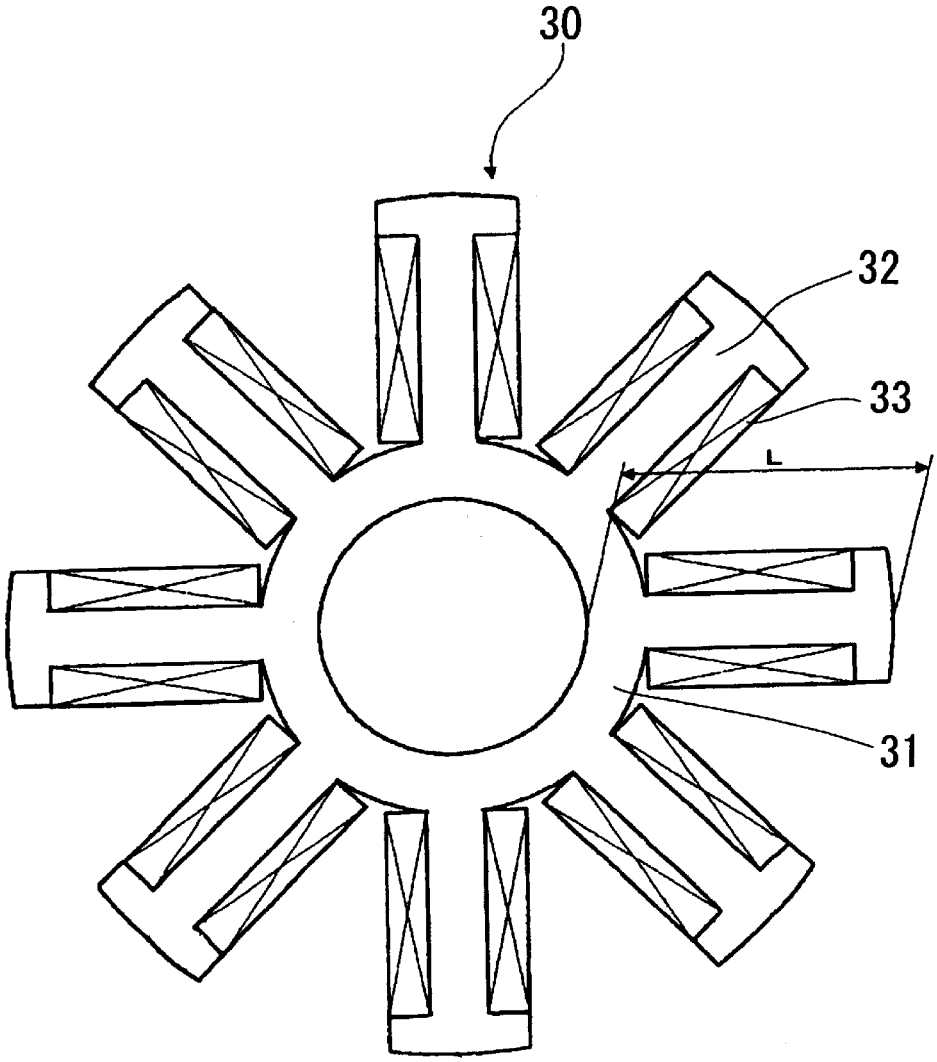
FIG. 4 is a plan view of a stator of the multifunction acoustic device of the present invention.

Referring to FIG. 4, the stator 30 comprises a spider having an annular hub 31 and eight spokes 32 radially projected from the hub 31, and a stator coil 33 wound on each spoke 32. The hub 31 is secured to the cylinder 26. The coils 33 are connected with each other so as to be excited in different polarities.

In order to improve the starting of rotation of the rotor 20, it may be preferable to change the length L of the spokes 32.

Figure 6:
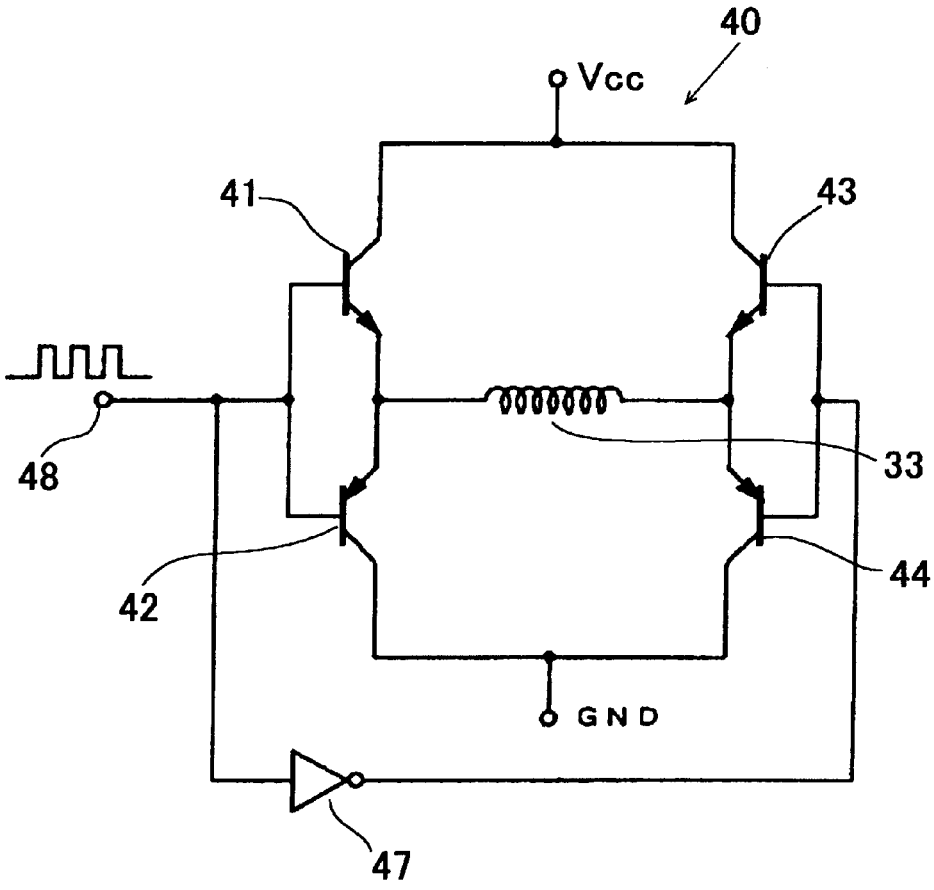
FIG. 6 is a driving circuit used in the multifunction acoustic device of the present invention.
Figure 7:
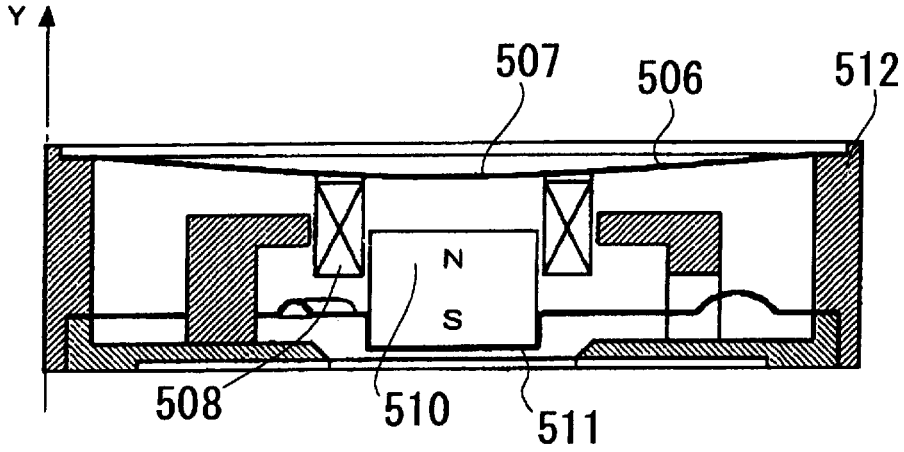
FIG. 7 PRIOR ART
FIG. 7 is a sectional view of a conventional electromagnetic induction converter.
Figure 8:
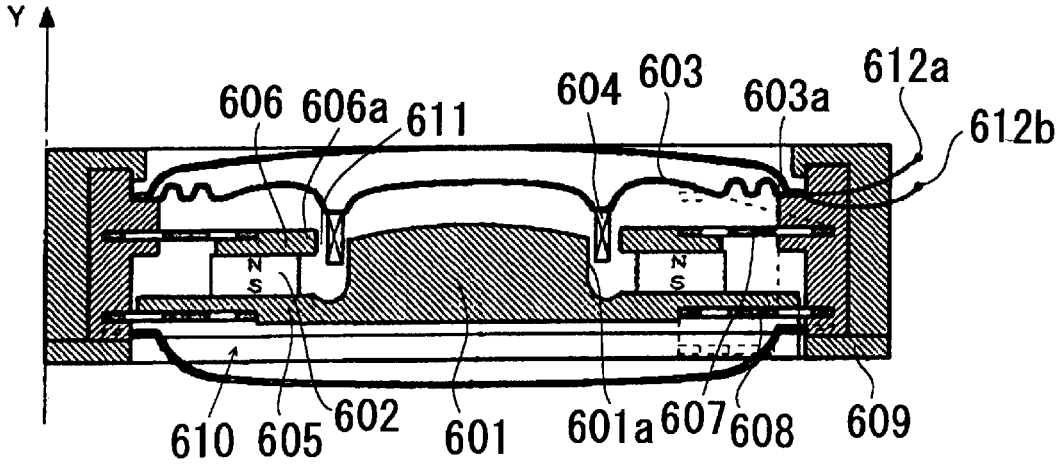
FIG. 8 PRIOR ART
FIG. 8 is a sectional view showing a conventional multifunction acoustic device.
Figure 9:
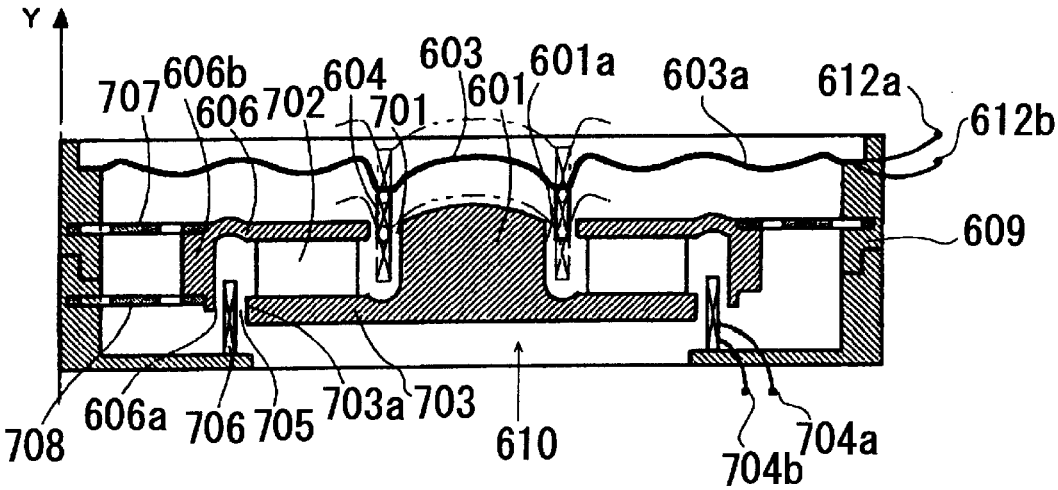
FIG. 9 PRIOR ART
FIG. 9 is a sectional view showing another conventional multifunction acoustic device.

Thus, the rotor 20 and stator 30 are composed in a synchronous motor. It will be understood that the motor can be made into a stepping motor Referring to FIG. 6, a rotor driving circuit 40 comprises a pair of NPN transistors 41 and 43 and a pair of PNP transistors 42 and 44 which are connected crosswise, interposing the stator coil 33. Bases of the transistors 41 and 42 are connected to an input terminal 48, bases of the transistors 43 and 44 are connected to the input terminal 48 through an inverter 47.

In operation, when a high frequency signal is applied to input terminals 19*a* and 19*b* (FIG. 1) of the voice coil 15, the speaker diaphragm 14 is vibrated in the Y direction (FIG. 1) to generate sounds.

When a low frequency signal of about 100–300 Hz is applied to input terminal 48 of the driving circuit 40, the transistors 41 and 44 are turned on at a high level of the input signal. Consequently, a current passes the stator coils 33 through the transistors 41 and 44 from the Vcc to GND. And the current passes through the transistor 43, coils 33 in different polarities. Thus, the rotor 20 is rotated at the driving low frequency. Since the weight 25 is eccentrically mounted on the rotor 20, the rotor vibrates in radial direction. The vibration is transmitted to user's body through the frame 1 and a case of the device so that a calling signal is informed to the user.

On the other hand, the cooling fan 27 cools the coils 33, and the projections 28 cool the voice coil 11. Furthermore, the heat of the voice coil 11 is discharged passing through the holes 29.

The number N of rotation of the rotor is expressed as follows.

$$N=60f/P\ (rpm) \quad 1$$

where P is the number of poles of the rotor, f is driving frequency.

The load torque TL is expressed as follows.

$$TL=\mu rR\omega^2M(N\cdot m) \quad 2$$

where M is the mass of weight 25 of the rotor,

R is the length between the center of the rotor shaft 16 and the center of gravity of the weight 25, r is the radius of the rotor shaft 16, $\mu$ is the friction coefficient between the rotor shaft 16 and the rotor 20, $\omega$ is the number of rotation (rad/sec) of the rotor 20.

Since the rotor 20 merely bears the load torque TL, the power consumption of the device is small.

If a lower frequency signal is applied to the input terminal 48 to rotate the rotor 20 during the generating sounds by the speaker diaphragm 14, the magnetic flux density in the first gap 11 does not change from the magnetic flux density when only the speaker diaphragm 14 is vibrated. Therefore, quality of sounds generated by the diaphragm does not reduce even if the rotor 20 rotates.

Although the synchronous motor is used in the above described embodiments, other motors such as a stepping motor, a direct current motor and others can be used. Further, the rotor can be disposed outside the stator.

From the foregoing description, it will be understood that the present invention provides a multifunction acoustic device which may generate sounds and vibration of the frame at the same time without reducing sound quality. In the prior art, since the speaker diaphragm and the magnetic composition are vibrated in the same direction, the thickness of the device increases. In the device of the present invention, since the magnetic composition rotates, the thickness of the device can be reduced.

Furthermore, coils provided in the acoustic device are cooled by cooling devices, thereby improving the functions of the acoustic device.

While the invention has been described in conjunction with preferred specific embodiment thereof, it will be understood that this description is intended to illustrate and not limit the scope of the invention, which is defined by the following claims.

What is claimed is:

1. A multifunction acoustic device comprising:

a frame;

a rotor shaft rotatably supported in the frame by bearings;

a rotor rotatably supported in the frame by the rotor shaft, and having a yoke with a central upward cylindrical portion and an annular flat portion extending from and around the central upward cylindrical portion;

a stator provided in the frame within the central upward cylindrical portion of the yoke;

an annular first permanent magnet provided on the annular flat portion of the yoke;

an annular second permanent magnet provided on an annular, inside wall of the central upward cylindrical portion of the yoke;

a diaphragm supported in the frame;

a voice coil secured to the diaphragm and inserted in a gap defined by the first permanent magnet and an outer surface of the central upward cylindrical portion of the yoke; and at least two coils provided on the stator for forming magnetic fluxes between the annular second permanent magnet and the stator so as to rotate the rotor.

2. The device according to claim 1 further comprising eccentric means provided on the rotor for vibrating the rotor during the rotation of the rotor.

3. The device according to claim 1 wherein the stator comprises a spider having a hub and a plurality of spokes.

4. The device according to claim 1 wherein the coils are provided on spokes of the spider.

5. The device according to claim 2 wherein the eccentric means is a weight eccentrically provided in the rotor.

6. The device according to claim 3 further comprising an annular top yoke mounted on the first permanent magnet for forming the gap between the top yoke and the cylindrical portion of the yoke.

7. The device according to claim 5 further comprising a driving circuit for energizing the coils for rotating the rotor.

8. The device according to claim 7 wherein the rotor and the stator are formed into a synchronous motor.

9. The device according to claim 8 wherein the periphery of the second permanent magnet has a plurality of magnetic poles corresponding to the spokes of the stator.

* * * * *